United States Patent [19]

Forrer

[11] 4,034,852

[45] July 12, 1977

[54] ARTICLE CARRIER

[75] Inventor: Homer W. Forrer, Jonesboro, Ga.

[73] Assignee: The Mead Corporation, Dayton, Ohio

[21] Appl. No.: 654,701

[22] Filed: Feb. 2, 1976

[51] Int. Cl.[2] ..... B65D 5/46; B65D 75/06

[52] U.S. Cl. ..... 206/141; 206/193; 206/427; 229/40; 229/52 B; 229/52 BC

[58] Field of Search ..... 224/45 AB; 206/141, 206/142, 143, 147, 149, 152, 154, 156, 157, 158, 175, 193, 194, 197, 427, 429; 229/40, 52 BC, 52 B

[56] References Cited

U.S. PATENT DOCUMENTS

| | | | |
|---|---|---|---|
| 2,558,715 | 6/1951 | Williamson | 206/194 |
| 2,946,436 | 7/1960 | Williamson | 206/141 |
| 3,164,290 | 1/1965 | Paredes | 206/141 |
| 3,249,254 | 5/1966 | Forrer | 206/197 |
| 3,258,190 | 6/1966 | Wood | 206/152 |
| 3,424,368 | 1/1969 | Forrer | 206/197 |
| 3,462,011 | 8/1969 | Farquhar | 206/152 |
| 3,593,849 | 7/1971 | Helms et al. | 206/427 |
| 3,750,874 | 8/1973 | Detzel et al. | 206/141 |
| 3,977,518 | 8/1976 | Arneson | 229/28 BC |

FOREIGN PATENT DOCUMENTS

| | | | |
|---|---|---|---|
| 659,888 | 11/1960 | Italy | 229/29 E |

*Primary Examiner*—Stephen P. Garbe
*Assistant Examiner*—Bruce H. Bernstein
*Attorney, Agent, or Firm*—Walter M. Rodgers; Walter A. Rodgers

[57] ABSTRACT

An open ended wraparound type carrier for packaging at least one row of articles comprises a top panel, a pair of top sloping panels foldably joined respectively to the sides of the top panel, a pair of side walls foldably joined respectively to the top sloping panels remote from the top panel, a pair of bottom panels foldably joined respectively to the bottom edges of said side wall panels, a pair of hand gripping panels struck from the top panel and from the top sloping panels and joined to the top panel respectively along a pair of spaced substantially parallel fold lines, and each end edge of each of said hand gripping panels being disposed in abutting engagement with the adjacent one of said top sloping panels.

5 Claims, 2 Drawing Figures

ARTICLE CARRIER

Generally open ended article carriers of the wraparound variety are well suited to be used only once due to the inherent need to destroy the package at the time the promary packages are removed from the carrier. Whenever certain of the articles, especially those disposed in the interior of the package, are broken, such as in transit, the carrier is rendered useless and must be discarded.

Another problem with known wraparound carriers results from weakness in the handle due to the typical single ply construction of the carrier itself. Since the trend is to larger and larger primary packages, wraparound carrier handles frequently are strengthened by resorting to such means as costly lamination of the handle area.

In addition some handles in wraparound type carriers are formed using a pair of panels which are struck from the top panel and from the top sloping panels or side walls and which are foldably joined to each other along a common fold line. Other wraparound carrier handle panels are joined to the top panel along spaced fold lines and are formed in a quadrilateral configuration. Still other handles are formed from panels which are joined to the top panel along spaced fold lines and angularly disposed inwardly with respect to the vertical. All of these handle structures are inherently weak and tend to bend or tear whenever the carrier is transported because the majority of the carrier weight is borne at the point where the ends of the handle are joined to either the top panel or to the top sloping panels.

According to this invention, a wraparound carrier is modified so as to simulate certain features of a basket type carrier and is constructed so that a broken bottle may be removed and replaced without discarding the entire package and an unusually strong handle is provided which is adequate for use with large bottles. A carrier according to this invention is usable to return returnable bottles and comprises a top panel, a pair of top sloping panels foldably joined respectively to opposite sides of the top panel, a pair of side walls foldably joined respectively along the edges of the top sloping panels remote from the top panel, a pair of bottom panels foldably joined respectively along the bottom edges of said side wall panels, a pair of hand gripping panels struck from the top panel and from the pair of top sloping panels and joined to the top panel respectively along a pair of spaced substantially parallel fold lines, and the end edges of said hand gripping panels being disposed at substantially the same angle to vertical as said top sloping panels and each edge being disposed in general abutting engagement with the adjacent one of said top sloping panels.

Figure 1:
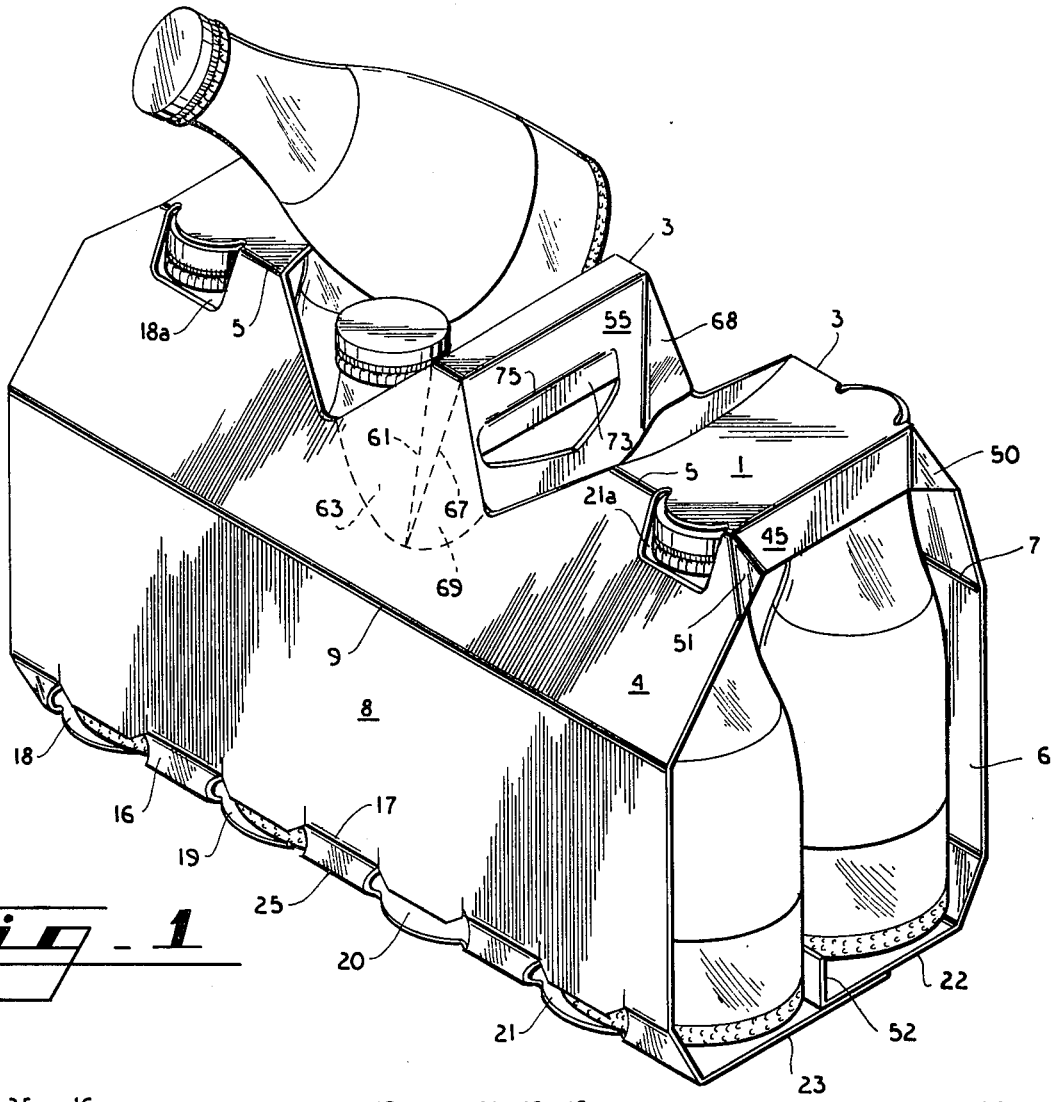
Figure 2:
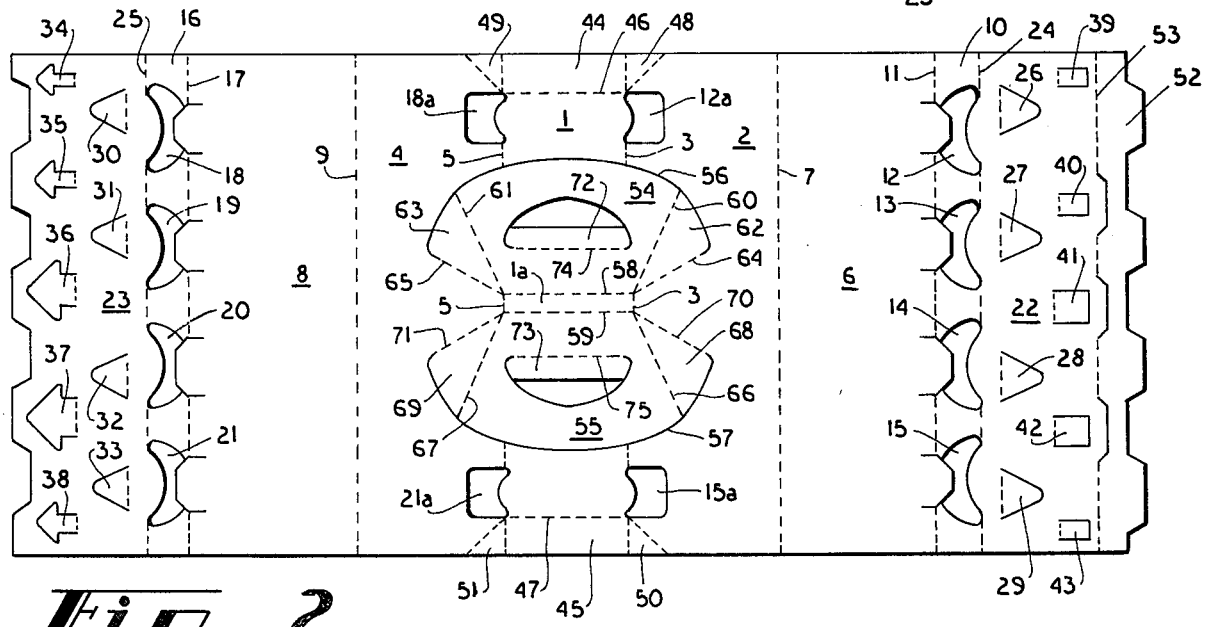

For a better understanding of the invention, reference may be had to the following detailed description taken in conjunction with the accompanying drawings in which:

FIG. 1 is a perspective view of an article carrier constructed according to this invention with one article partially removed; and in which FIG. 2 is a plan view of a blank from which the carrier depicted in FIG. 1 is formed.

In the drawings, the numeral 1 designates the top panel of the carrier. Top sloping panel 2 is foldably joined to top panel 1 along interrupted fold line 3 and; likewise, top sloping panel 4 is foldably joined to top panel 1 along interrupted fold line 5.

Side wall panel 6 is foldably joined to the lower edge of top sloping panel 2 along fold line 7 while a similar side wall panel 8 is foldably joined to the lower edge of top sloping panel 4 along fold line 9.

Bottom sloping panel 10 is joined along fold line 11 to side wall panel 6 and is provided with a plurality of apertures 12, 13, 14 and 15. Similarly bottom sloping panel 16 is foldably joined to the lower edge of side wall panel 8 along fold line 17. Also a plurality of apertures 18, 19, 20 and 21 are formed in bottom sloping panel 16. Apertures 12–15 and 18–21 receive the lower portions of the primary packages as is well known. For receiving the tops of the primary packages disposed at each end of the carrier, apertures 12a, 15a, 18a, and 21a are provided.

The bottom of the carrier is of a composite construction and comprises bottom panels 22 and 23. Bottom panel 22 is foldably joined to bottom sloping panel 10 along fold line 24 and; likewise, bottom panel 23 is joined to bottom sloping panel 16 along fold line 25.

In order to envelope the blank tightly around the primary packages, apertures are provided for receiving suitable machine elements. More specifically tightening apertures 26, 27, 28 and 29 are formed in bottom panel 22. In like manner tightening apertures 30, 31, 32 and 33 are formed in bottom panel 23. Machine tightening elements enter the appropriate apertures and then move inwardly to tighten the package securely about the primary packages. When bottom panels 22 and 23 are in the proper overlapping position, locking tabs 34–38 are driven through corresponding apertures defined by retaining tabs 39–43 as is well known.

In order to provide billboard areas, end panels 44 and 45 are provided and are joined respectively to top panel 1 along fold lines 46 and 47. In addition end panel 44 is joined to top sloping panels 2 and 4 respectively by means of web panels 48 and 49. In like manner end panel 45 is joined to top sloping panels 2 and 4 by means of web panels 50 and 51 respectively.

To provide medial article separation for the lower portions of the primary packages, medial keel panel 52 is provided and is foldably joined to bottom panel 22 along fold line 53.

According to this invention, hand gripping panels 54 and 55 are struck from top panel 1 as well as from top sloping panels 2 and 4 by means of cut lines 56 and 57. In addition hand gripping panel 54 is joined to top panel 1 along fold line 58 and in similar fashion hand gripping panel 55 is joined to top panel 1 along fold line 59. Also hand gripping panel 54 is foldably joined along end edges 60 and 61 thereof respectively to web panels 62 and 63. Web panels 62 and 63 are joined respectively to top sloping panels 2 and 4 along fold lines 64 and 65. Likewise hand gripping panel 55 is foldably joined along end edges 66 and 67 respectively to web panels 68 and 69. Web panels 68 and 69 are joined to top sloping panels 2 and 4 along fold lines 70 and 71 respectively. In addition hand cushioning panels 72 and 73 are joined respectively to hand gripping panels 54 and 55 along fold lines 74 and 75.

Therefore it can be seen that when the carrier is formed in the set up condition as shown in FIG. 1, the hand gripping panels 54 and 55 are transversely disposed between the interior primary packages allowing them to be easily replaced should inadvertent breakage occur. The fact that the lower edges of panels 54 and 55 are in engagement with each other affords sufficient space for the neck of adjacent bottles to clear the handle panels for easy removal. In addition the carrier can be utilized to transport returnable heavy primary packages because of the strong handle structure.

The strong handle feature of the invention is accomplished by means of the snug abutting engagement of end edges 60 and 66 with top sloping panel 2 and of end edges 61 and 67 with top sloping panel 4. Therefore when the carrier is lifted by the handle, the weight is distributed to top sloping panels 2 and 4 over a triangular area defined by end edges 61, 67 and 5 at one end and by similar structure at the other end.

Also the handle is less likely to bend or twist due to separator portion 1a formed in panel 1. As shown in FIG. 2, the outer periphery of separator portion 1a is formed by spaced fold lines 58 and 59 and the middle portions of interrupted fold lines 3 and 5. Stated otherwise, if the separator panel 1a were omitted and the fold lines 58 and 59 made substantially coincident, the handle would tend to flex and become weakened at the parts of panels 54 and 55 which are immediately adjacent the ends of fold lines 74 and 75. In addition flexing and twisting are virtually precluded by the fact that the web panels 62, 63, 68 and 69 are disposed in flat face contacting relation to top sloping panels 2 and 4 and thus firmly secure the ends 60 and 61 of panel 54 and the ends 66 and 67 of panel 55 against movement relative to top sloping panels 2 and 4.

Therefore by this invention an article carrier is provided which is well suited for packaging of very large primary packages due to the strong handle construction which by conventional tests is far superior to known arrangements. In addition a carrier is provided in which certain of the primary packages can be removed without weakening or destroying the package. This elimination of the need to destroy the package allows the carrier to be used in connection with returnable primary packages and accomodates replacement of a broken bottle if need be. Also although the embodiment described and shown in the drawings depicts a carrier having a top panel disposed in the same plane as the tops of the primary packages, this invention could also be utilized in a carrier of the so-called "neck-through" type.

The embodiments of the invention in which an exclusive property or privilege is claimed are defined as follows:

1. A carrier for packaging at least one row of articles comprising a top panel, a pair of top sloping panels foldably joined respectively to opposite sides of said top panel, a pair of side wall panels foldably joined respectively to the edges of said top sloping panels remote from said top panel, a pair of bottom panels foldably joined respectively along the bottom edges of said side wall panels, a pair of hand gripping panels each having a pair of spaced end edges, said pair of hand gripping panels being struck from said top panel and from said pair of top sloping panels and joined to said top panel respectively along a pair of spaced substantially parallel fold lines, said end edges of said hand gripping panels being disposed at substantially the same angle to vertical as said top sloping panels, and each of said end edges being disposed in general abutting engagement with the adjacent one of said top sloping panels so that the weight of the carrier is distributed over substantial areas of said top sloping panels, and a unitary web panel joined to each end edge of said hand gripping panels and to the adjacent one of said top sloping panels, each of said web panels being disposed respectively in substantial face contacting relation over the entire area thereof with said adjacent top sloping panels.

2. A carrier according to claim 1 wherein a pair of apertures are formed respectively in said pair of hand gripping panels.

3. A carrier according to claim 1 wherein the portion of said top panel intermediate said parallel fold lines and the portions of said fold lines joining said top panel and said top sloping panels beteen said parallel fold lines define a separator portion.

4. A carrier for packaging at least one row of articles comprising a top panel, a pair of top sloping panels foldably joined respectively to opposite sides of said top panel, a pair of side wall panels foldably joined respectively to the edges of said top sloping panels remote from said top panel, a pair of bottom sloping panels foldably joined respectively to the bottom edges of said side wall panels, a pair of bottom panels foldably joined respectively along the edges of said bottom sloping panels remote from the edges which are joined to said side wall panels, fastening means for securing said bottom panels together, a pair of hand gripping panels each having a pair of spaced end edges, said pair of hand gripping panels being struck from said top panel and from said pair of top sloping panels and joined to said top panel respectively along a pair of spaced substantially parallel fold lines, said pair of hand gripping panels being disposed transversely between adjacent articles, a pair of apertures formed respectively in said pair of hand gripping panels, the lower portions of said hand gripping panels being disposed in abutting relation with each other, and said edges of said hand gripping panels being disposed at substantially the same angle to vertical as said top sloping panels, each of said end edges being disposed in general abutting engagement with the adjacent one of said top sloping panels so that the weight of the carrier is distributed over substantial areas of said top sloping panels.

5. A carrier for packaging at least one row of articles comprising a top panel, a pair of top sloping panels foldably joined respectively to opposite sides of said top panel, a pair of side wall panels foldably joined respectively to the edges of said top sloping panels remote from said top panel, a pair of bottom panels foldably joined respectively along the bottom edges of said side wall panels, a pair of hand gripping panels each having a pair of spaced end edges, said pair of hand gripping panels being struck from said top panel and from said pair of top sloping panels and joined to said top panel respectively along a pair of spaced substantially parallel fold lines, said end edges of said hand gripping panels being disposed at substantially the same angle to vertical as said top sloping panels, each of said end edges being disposed in general abutting engagement with the adjacent one of said top sloping panels so that the weight of the carrier is distributed over substantial areas of said top sloping panels, and the lower portions of said hand gripping panels being disposed in abutting relation with each other.

* * * * *